US008040077B2

(12) United States Patent
Fujii et al.

(10) Patent No.: US 8,040,077 B2
(45) Date of Patent: Oct. 18, 2011

(54) STARTING CIRCUIT OF STARTING DEVICE FOR HIGH-PRESSURE DISCHARGE LAMP INCLUDING AUXILIARY LIGHT SOURCE, STARTING DEVICE INCLUDING THE STARTING CIRCUIT, AND LIGHTING SYSTEM INCLUDING THE STARTING DEVICE

(75) Inventors: Toshitaka Fujii, Himeji (JP); Atsuji Nakagawa, Himeji (JP)

(73) Assignee: Phoenix Electric Co., Ltd., Hyogo (JP)

( * ) Notice: Subject to any disclaimer, the term of this patent is extended or adjusted under 35 U.S.C. 154(b) by 422 days.

(21) Appl. No.: 12/382,593

(22) Filed: Mar. 19, 2009

(65) Prior Publication Data

US 2009/0322242 A1 Dec. 31, 2009

(30) Foreign Application Priority Data

Jun. 30, 2008 (JP) ..... 2008-171290

(51) Int. Cl.
*G05F 1/00* (2006.01)

(52) U.S. Cl. ..... 315/291; 315/289; 315/247; 315/307; 315/276; 315/312; 315/261

(58) Field of Classification Search ..... 315/289–291, 315/307, 254, 276, 209 R, 209 T, 209 CD, 315/244, 247, 261, 223, 224, 312, 82
See application file for complete search history.

(56) References Cited

U.S. PATENT DOCUMENTS

| | | | | |
|---|---|---|---|---|
| 6,437,519 | B1 * | 8/2002 | Ito | 315/291 |
| 6,756,744 | B2 | 6/2004 | Furukawa | |
| 6,914,383 | B2 * | 7/2005 | Yamashita et al. | 313/594 |
| 6,919,686 | B2 | 7/2005 | Okamoto et al. | |
| 2006/0170379 | A1 * | 8/2006 | Uchida | 315/312 |
| 2009/0224667 | A1 * | 9/2009 | Fujii et al. | 313/567 |

FOREIGN PATENT DOCUMENTS

| | | |
|---|---|---|
| JP | 08-008074 | 1/1996 |
| JP | 09-260079 | 10/1997 |
| JP | 2002-231473 | 8/2002 |
| JP | 2003-203605 | 7/2003 |
| JP | 2007-109510 | 4/2007 |
| JP | 2007-200607 | 8/2007 |

* cited by examiner

*Primary Examiner* — Haiss Philogene
(74) *Attorney, Agent, or Firm* — Kubotera & Associates, LLC

(57) ABSTRACT

A starting circuit of a starting device for a high-pressure discharge lamp including an auxiliary light source has a diode placed in a forward direction in one of a pair of output lines which connect a main lighting circuit for generating AC voltage to the high-pressure discharge lamp and the auxiliary light source; a capacitor having one end connected to a cathode side of the diode; a boosting transformer including a primary winding, and a secondary winding having one end connected to an anode side of the diode or to the other output line and also having the other end connected to the other end of the capacitor; a high-frequency voltage generation circuit for continuously generating high-frequency voltage in combination with the primary winding; and a short-circuit switch for maintaining a short-circuit condition at both ends of the diode after the high-pressure discharge lamp is started.

6 Claims, 9 Drawing Sheets

STARTING CIRCUIT OF STARTING DEVICE FOR HIGH-PRESSURE DISCHARGE LAMP INCLUDING AUXILIARY LIGHT SOURCE, STARTING DEVICE INCLUDING THE STARTING CIRCUIT, AND LIGHTING SYSTEM INCLUDING THE STARTING DEVICE

BACKGROUND OF THE INVENTION

1. Field of the Invention

The present invention relates to a starting circuit of a starting device for a high-pressure discharge lamp including an auxiliary light source, the starting circuit being capable of reliably starting the high-pressure discharge lamp including the auxiliary light source.

2. Description of the Related Art

A high-pressure discharge lamp is mainly provided for a lighting system which is used for a liquid crystal projector and an optical device such as an exposure device. In recent years, an auxiliary light source is arranged in a high-pressure discharge lamp in response to demand for reduction in initial start (cold start) time as well as in restart (hot start) time and in response to demand for lowering the voltage required for starting (e.g., Patent document 1: Japanese Laid-Open Patent Publication No. 2003-203605).

As shown in FIG. 9, an auxiliary light source 3 arranged in a lighting system 1 described in Patent document 1 includes a discharge chamber 7 having discharge space 7*a* enclosing therein material M2 which emits ultraviolet rays when excited by discharge, and a starting electrode 8 that is arranged so as to be opposite via the discharge chamber 7 to one of metal foils 6*b* which is embedded in one of sealing portions 5*b* of a high-pressure discharge lamp 2. A conductive wire 9 is electrically connected to the starting electrode 8 so as to apply high-frequency high voltage between the one of the metal foils 6*b* and the starting electrode 8. Such a configuration that has electrodes arranged outside the discharge space 7*a* is called "electrodeless type".

In order to start the high-pressure discharge lamp 2 of the lighting system 1, high-frequency high voltage is applied between the one of the metal foils 6*b* and the starting electrode 8. Dielectric barrier discharge is then generated between the one of the metal foils 6*b* and the starting electrode 8 via the discharge space 7*a* of the discharge chamber 7. The material M2 enclosed in the discharge space 7*a* is excited by the dielectric barrier discharge, thereby emitting ultraviolet rays UV. The ultraviolet rays UV irradiate light-emitting material M1 enclosed in a light-emitting portion 5*a* in the high-pressure discharge lamp 2, whereby the light-emitting material M1 is ionized. Consequently, discharge between main discharge electrodes 6*a* is accelerated, whereby the high-pressure discharge lamp 2 is started by applying lower voltage.

In order to start the auxiliary light source of the above-described "electrodeless type", high-frequency high voltage needs to be applied to the auxiliary light source so as to produce capacitive coupling and then to cause excitation. Accordingly, various types of starting devices for the high-pressure discharge lamp, which are capable of generating high-frequency high voltage, have been developed (e.g., Patent document 2: Japanese Laid-Open Patent Publication No. 2007-109510).

In a starting device 100 for a high-pressure discharge lamp disclosed in Patent document 2, as shown in FIG. 10, a voltage generation circuit 104 and an inverter 106 are connected to a high-pressure discharge lamp 102 via an output line 108 and the other output line 110 so as to supply stabilized electric power to the high-pressure discharge lamp 102. The output line 108 is connected to a secondary winding 114 of a transformer 112. A primary winding 116 of the transformer 112 and a capacitor 118 are connected in parallel with each other to constitute a parallel resonant circuit. Voltage having predetermined frequency is applied from periodical voltage applying means 120 to the primary winding 116 and the capacitor 118. That is, a starting circuit 122 for the high-pressure discharge lamp 102 is composed of the transformer 112, the capacitor 118, and the periodical voltage applying means 120.

To start the high-pressure discharge lamp 102, periodical voltage is applied from the periodical voltage applying means 120 to the primary winding 116 and the capacitor 118 (i.e., the parallel resonant circuit). When frequency of the voltage applied from the periodical voltage applying means 120 corresponds to fundamental resonant frequency or high-order resonant frequency of the parallel resonant circuit, resonant current flows through the parallel resonant circuit, and high voltage is generated in the primary winding 116. With the high voltage generated in the primary winding 116, higher voltage is generated in the secondary winding 114, the higher voltage being boosted in accordance with a turns ratio (a ratio of the number of turns of wire in the primary winding 116 to the number of turns of wire in the secondary winding 114).

The higher voltage generated in the secondary winding 114 is superimposed with output voltage from the voltage generation circuit 104 and the inverter 106, and the resultant voltage is applied to the high-pressure discharge lamp 102, whereby high-frequency high voltage can be applied to the high-pressure discharge lamp 102.

However, the starting device 100 for the high-pressure discharge lamp disclosed in Patent document 2 has the following problems. That is, in the starting device 100 for the high-pressure discharge lamp, the secondary winding 114 of the transformer 112 is placed in the output line 108, and high rated current is fed to the high-pressure discharge lamp 102 through the secondary winding 114 when light is emitted steadily. Therefore, there has been required a large-size, expensive transformer 112 which includes a secondary winding 114 capable of accommodating high rated current. As a result, the starting device 100 for the high-pressure discharge lamp needs to be upsized and thus becomes expensive.

SUMMARY OF THE INVENTION

The present invention is developed in view of the above-described problems of conventional art. A main object of the present invention is, thus, to provide a starting circuit of a starting device for a high-pressure discharge lamp including an auxiliary light source, the starting circuit being capable of reliably starting the high-pressure discharge lamp including the auxiliary light source and of reducing the size and cost of the starting device by using an inexpensive, small-size transformer.

A first aspect of the present invention is directed to a starting circuit 62 of a starting device for a high-pressure discharge lamp including an auxiliary light source. The starting circuit 62 includes: a diode 80 placed in a forward direction in one output line 76 of a pair of output lines 76 and 78 which connect a main lighting circuit 60 for generating DC voltage to the high-pressure discharge lamp 12 and the auxiliary light source 14; a capacitor 86 having one end connected to a cathode side of the diode 80; a boosting transformer 84 including primary windings 88 and 89, and a secondary winding 90 having one end connected to an anode side of the diode 80 or to the other output line 78 and also having the other end connected to the other end of the capacitor 86; and a high-frequency voltage generation circuit 82 for continuously generating high-frequency voltage in combination with the primary windings 88 and 89.

According to the starting circuit 62, as shown in FIG. 1, to start the DC-powered high-pressure discharge lamp 12, high-frequency voltage is generated at both ends of the primary winding 88 by actuating the high-frequency voltage generation circuit 82, and the high-frequency voltage is boosted in accordance with a turns ratio of the primary winding 88 to the secondary winding 90, then the boosted high-frequency voltage v1 is generated at both ends of the secondary winding 90. As shown in FIG. 2, the high-frequency voltage v1 is "high-frequency high voltage (AC)".

When the high-frequency voltage v1 is generated in the secondary winding 90, due to rectification by the diode 80, the capacitor 86 is charged with the high-frequency voltage v1 of positive half cycles, whereby DC voltage v2 is generated at both ends of the capacitor 86.

On the other hand, the secondary winding 90 of the boosting transformer 84 has one end connected to an anode side of the diode 80 which is placed in the forward biased condition in one of the output lines 76 (a direction allowing current to flow from the main lighting circuit 60 to the high-pressure discharge lamp 12 or to return from the high-pressure discharge lamp 12 to the main lighting circuit 60, which is to be used hereinafter in the same manner), and also has the other end connected to a cathode side of the diode 80 via the capacitor 86. Accordingly, as shown in FIG. 3, at both ends of the diode 80, composite voltage v3 (DC+AC) is generated, which is a composite between the high-frequency voltage v1 generated in the secondary winding 90 and the DC voltage v2 generated at the capacitor 86. Since a peak voltage in the positive half cycles of the high-frequency voltage v1 is approximately equal to a voltage of the DC voltage v2 (=600V), the composite voltage v3 is high-frequency voltage which oscillates only in a positive area (>0V).

Since the composite voltage v3 is generated at both ends of the diode 80, composite voltage v4 (DC+AC) is applied to the high-pressure discharge lamp 12 and the auxiliary light source 14, the composite voltage v4 being a composite between the composite voltage v3 (=voltage v3 for starting) generated at both ends of the diode 80 and output voltage v0 from the main lighting circuit 60 (see FIG. 4).

The composite voltage v4 is obtained by superimposing the high-frequency composite voltage v3 with the DC output voltage v0, and thus has a high-frequency element which continuously oscillates in the positive area. Accordingly, as shown in FIG. 5, capacitive coupling is produced between an internal electrode 42 and an external electrode 44 of the "single-electrode type" auxiliary light source 14 in which only one of the electrodes is placed inside the sealed container 40 ("electrodeless type" may be used.), whereby it is possible to emit light from the auxiliary light source 14.

In addition, not only the above-described high-frequency element but also the direct current element v4' of the composite voltage v4 are applied between the main discharge electrodes 34*a* and 34*b* of the high-pressure discharge lamp 12.

In this manner, the high-frequency element of the composite voltage v4 having high peak voltage and the direct current element v4' thereof are applied between the main discharge electrodes 34*a* and 34*b* of the high-pressure discharge lamp 12, and ultraviolet rays included in the light L emitted from the auxiliary light source 14 irradiate the light-emitting material 30 and the main discharge electrodes 34 which are enclosed in the arc tube 26 of the high-pressure discharge lamp 12, whereby dielectric breakdown is generated easily between the main discharge electrodes 34*a* and 34*b*. With the starting circuit 62, it is possible to easily and reliably start the high-pressure discharge lamp 12.

Moreover, the secondary winding 90 of the boosting transformer 84 is connected to the capacitor 86 in series. Therefore, while light is emitted steadily, direct current from the main lighting circuit 60 consistently flows through the diode 80, and is supplied to the high-pressure discharge lamp 12, instead of being supplied to the secondary winding 90 of the boosting transformer 84 and the capacitor 86. Accordingly, the secondary winding 90 need not be high-current durable, and thus a small-size, inexpensive boosting transformer 84 can be used.

In addition, in the starting device 100 for the high-pressure discharge lamp according to above-described Patent document 2, the high-frequency voltage generated in the secondary winding 114 of the transformer 112 is directly superimposed with the output voltage from the voltage generation circuit 104 and the inverter 106, and the composite voltage is applied to the high-pressure discharge lamp 102. On the other hand, in the present invention, the composite voltage v3, which is the composite between the high-frequency voltage v1 generated in the secondary winding 90 of the boosting transformer 84 and the rectified DC voltage v2, is superimposed with the output voltage v0 from the main lighting circuit 60, and then a resultant composite voltage is applied to the high-pressure discharge lamp 12 and the auxiliary light source 14. Accordingly, voltage applied to the high-pressure discharge lamp 12 and the auxiliary light source 14 is higher than that supplied from the starting device 100 for the high-pressure discharge lamp according to Patent document 2, and thus it is possible to further improve starting characteristics of the high-pressure discharge lamp 12.

A second aspect of the present invention is directed to a starting circuit 62' for an AC-powered high-pressure discharge lamp 12'. The starting circuit 62' includes: a diode 80 placed in a forward direction in one output line 76 of a pair of output lines 76 and 78 which connect a main lighting circuit 60' for generating AC voltage to the high-pressure discharge lamp 12' and an auxiliary light source 14; a capacitor 86 having one end connected to a cathode side of the diode 80; a boosting transformer 84 including primary windings 88 and 89, and a secondary winding 90 having one end connected to an anode side of the diode 80 or to the other output line 78 and also having the other end connected to the other end of the capacitor 86; a high-frequency voltage generation circuit 82 for continuously generating high-frequency voltage in combination with the primary windings 88 and 89; and a short-circuit switch 98 for maintaining a short-circuit condition at both ends of the diode 80 after the high-pressure discharge lamp 12' is started.

A configuration of the above-described invention is almost the same as that according to the aspect 1. However, after the high-pressure discharge lamp 12' is started, alternating current is supplied to the high-pressure discharge lamp 12', and thus both ends of the diode 80 need to be short-circuited. That is, the present invention is different from the invention according to the aspect 1 in that the short-circuit switch 98 for maintaining a short-circuit condition at both ends of the diode 80 is provided.

According to the present invention (according to the aspect 1 and 2), rated current of the high-pressure discharge lamp is not fed through the secondary winding of the boosting transformer. Thus, it is possible to provide: a starting circuit of a starting device for a high-pressure discharge lamp including an auxiliary light source; a starting device for the high-pressure discharge lamp including an auxiliary light source, the starting device being equipped with the starting circuit; and a lighting system equipped with the starting device for a high-pressure discharge lamp including an auxiliary light source, which are all capable of reducing the size and cost of the starting device for a high-pressure discharge lamp while using a small-size, inexpensive boosting transformer.

DETAILED DESCRIPTION OF THE INVENTION

First, a lighting system 10 having a DC-powered high-pressure discharge lamp 12 will be described in a first embodiment, and then a lighting system 10' having an AC-powered high-pressure discharge lamp 12' will be described in a second embodiment mainly in relation to different features between the same and the lighting system 10 of the DC-powered type.

First Embodiment

Figure 1:
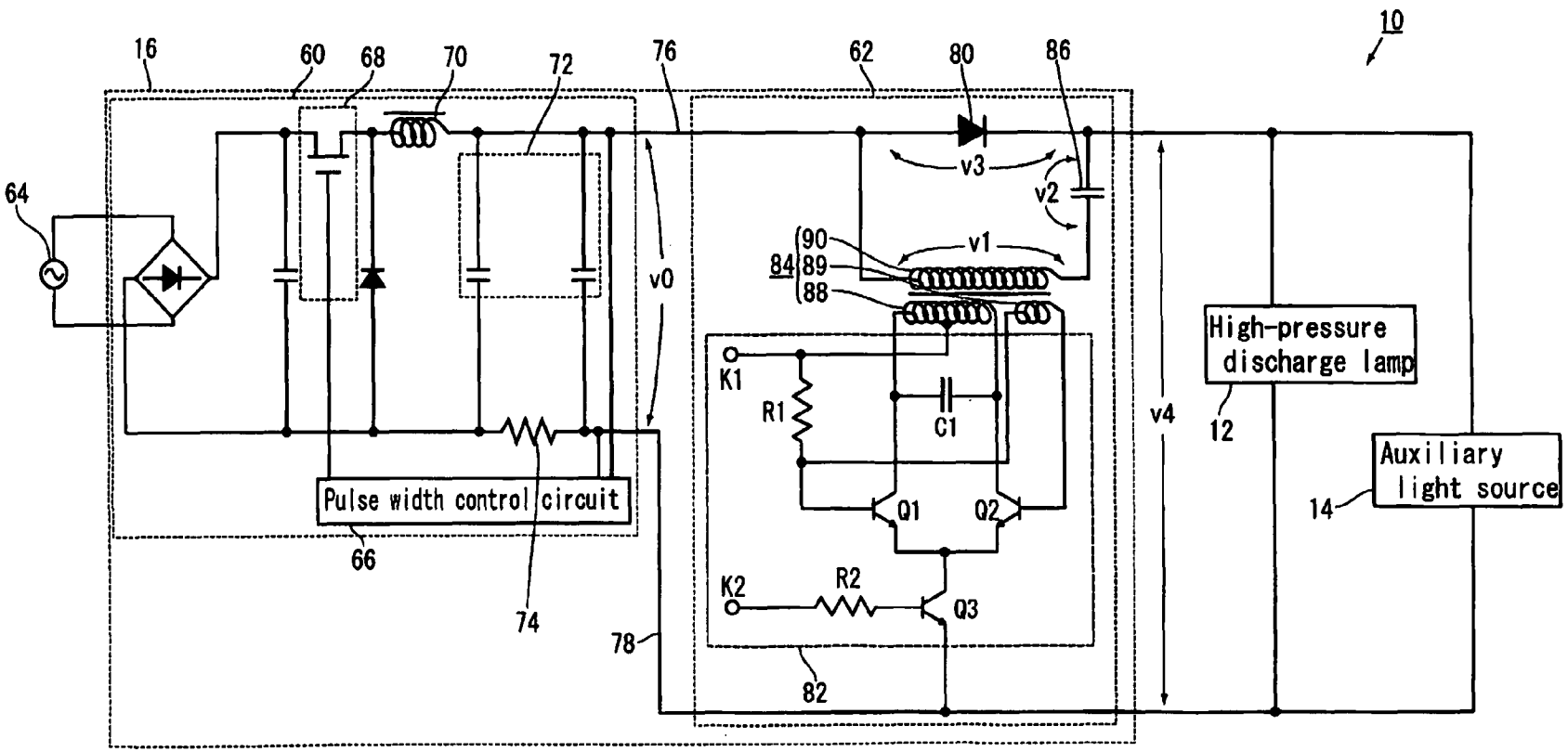
FIG. 1 is a schematic diagram showing a lighting system according to the present invention.

As shown in FIG. 1, the lighting system 10 according to the present invention is composed of the DC-powered high-pressure discharge lamp 12, an auxiliary light source 14, and a starting device 16.

Figure 5:
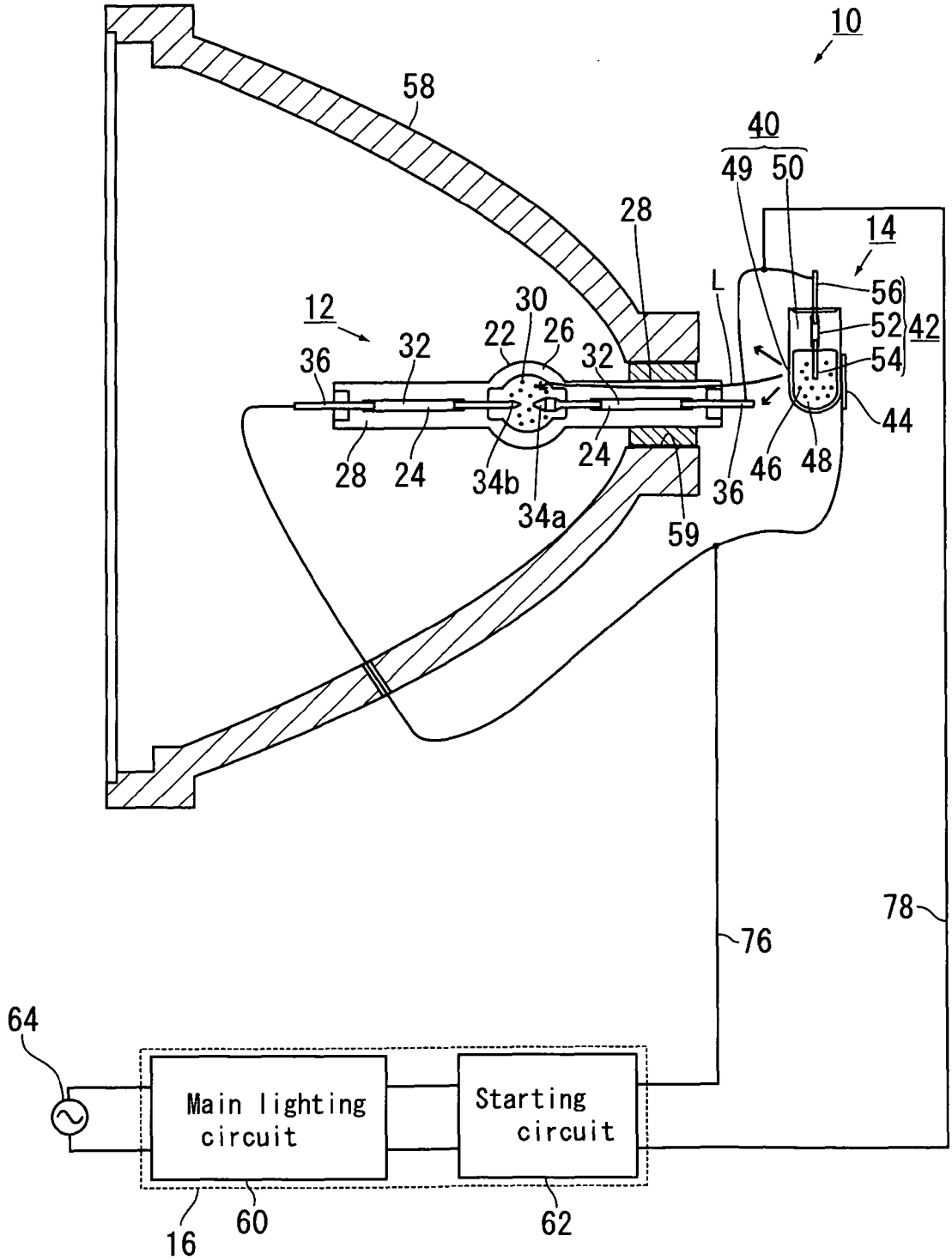
FIG. 5 is a diagram showing an outline of a lighting system according to the present invention.

As shown in FIG. 5, the high-pressure discharge lamp 12 is composed of a sealed chamber 22 and a pair of main discharge mounts 24. The sealed chamber 22 is composed of an arc tube 26, which has an almost spherical shape and also has an internal space, and sealing portions 28 which extend from both sides of the arc tube 26. The sealed chamber 22 is made of silica glass which has no thermal expansion and thermal contraction.

Enclosed in the internal space in the arc tube 26 are, light-emitting material 30 such as inert gas (an argon gas, a xenon gas, or the like) or mercury vapor, or halide which causes Halogen Cycle. In the internal space, a pair of main discharge electrodes 34*a* and 34*b* (to be described later) are arranged so as to face each other. When voltage is applied between the main discharge electrodes 34*a* and 34*b*, discharge is caused by dielectric breakdown, whereby the light-emitting material 30 is excited and then emits light.

Each of the main discharge mounts 24 is composed of a molybdenum made metal foil 32, a tungsten made main discharge electrode 34*a* or 34*b* whose one end is arranged in the internal space in the arc tube 26 and whose other end is fixed to one end of the metal foil 32 by welding or the like, and an external lead rod 36 whose one end is fixed to the other end of the metal foil 32 and whose other end protrudes outward from the sealing portion 28. As shown in the figure, in the case of the DC-powered high-pressure discharge lamp 12, the anode main discharge electrode 34*a* is formed larger than the cathode main discharge electrode 34*b*.

In the present embodiment, the high-pressure discharge lamp 12 of a double-ended type is used, however, that of a single-ended type may also be used. In the case of the AC-powered high-pressure discharge lamp 12', which is to be described later, the pair of main discharge electrodes 34*c* and 34*d* are formed to be equal in size to each other.

The auxiliary light source 14 is of a single-electrode type, and composed of a sealed container 40, an internal electrode 42 and an external electrode 44.

The sealed container 40 is composed of a light-emitting portion 49 having an internal space 48 enclosing therein light-emitting material 46, and a sealing portion 50 provided at one end of the light-emitting portion 49. As with the sealed chamber 22 of the high-pressure discharge lamp 12, the sealed container 40 is molded with silica glass which has no thermal expansion and thermal contraction.

The internal electrode 42 is composed of a molybdenum made metal foil 52 embedded in the sealing portion 50 of the sealed container 40, an auxiliary light source electrode 54 made of tungsten and having one end arranged inside the sealed container 40 and the other end fixed to one end of the metal foil 52, and an external lead rod 56 having one end fixed to the other end of the metal foil 52 of the auxiliary light source and also having the other end protruding outward from the sealing portion 50 of the auxiliary light source. In order to downsize the auxiliary light source 14, all component parts of the internal electrode 42 may be formed with molybdenum made metal foil.

The external electrode 44 is a metal plate, and is arranged on an outside surface of the sealed container 40 so as to face the light-emitting portion 49. The external electrode 44 may be formed by winding a conductive material such as a nickel wire around the sealed container 40.

The high-pressure discharge lamp 12 may be fixed to a reflector if necessary. The reflector 58 is of a concave shape, accommodates the high-pressure discharge lamp 12 extending from its central portion. The light generated from the arc tube 26 is reflected on the reflector 58 to a forward direction.

As shown in FIG. 1, the starting device 16 is composed of a main lighting circuit 60 and a starting circuit 62.

The main lighting circuit 60 receives voltage from an AC power supply 64 (a DC power supply may be used.), and stably supplies electric power to the main discharge electrodes 34*a* and 34*b* of the high-pressure discharge lamp 12, while responding to fluctuations and temporal changes in voltage of the high-pressure discharge lamp 12. The main lighting circuit 60 includes a pulse width control circuit 66 for outputting a pulse width control signal corresponding to voltage and starting current of the high-pressure discharge lamp 12, an FET switching section 68 for switching in accordance with the pulse width control signal outputted from the pulse width control circuit 66, a reactor 70 and a smoothing capacitor 72 which smooth pulse-switching current outputted from the FET switching section 68 and which stably supply the smoothed pulse-switching current to the high-pressure discharge lamp 12, a sense resistor 74 for detecting the current for starting the high-pressure discharge lamp 12 as sense voltage, and output lines (a positive output line 76 and a zero voltage line 78) for applying voltage to the high-pressure discharge lamp 12 and the auxiliary light source 14.

When the high-pressure discharge lamp 12 is started, the starting circuit 62 superimposes "high-frequency high voltage" which produces capacitive coupling between the internal electrode 42 and the external electrode 44 of the auxiliary light source 14 to output voltage from the main lighting circuit 60, and applies the resultant voltage between the main discharge electrodes 34*a* and 34*b* of the high-pressure discharge lamp 12 and also between the internal electrode 42 and the external electrode 44 of the auxiliary light source 14. The starting circuit 62 includes a diode 80, a high-frequency voltage generation circuit 82, a boosting transformer 84, and a capacitor 86.

The diode 80 is placed in the positive output line 76 of the main lighting circuit 60 in the forward biased condition (a direction in which current flows from the main lighting circuit 60 to the high-pressure discharge lamp 12 and the auxiliary light source 14).

In combination with the primary windings 88 and 89 of the boosting transformer 84 (to be described later), the high-frequency voltage generation circuit 82 continuously generates high-frequency voltage at both ends of the primary winding 88. In the present embodiment, a typical push-pull inverter circuit is adopted, and the high-frequency voltage generation circuit 82 includes three transistors Q1 to Q3, two resistors R1 and R2, and a capacitor C1. The high-frequency voltage generation circuit 82 is not limited to the push-pull inverter circuit, but any circuit may be used provided that the circuit is capable of continuously generating high-frequency voltage.

The boosting transformer 84 includes the primary windings 88 and 89 (the primary winding 89 being specifically referred to as a feedback winding 89) and a secondary winding 90. A degree of boosting is determined based on a turns ratio of the primary winding 88 to the secondary winding 90.

The secondary winding 90 has one end connected to an anode side of the diode 80 placed in the positive output line 76, and also has the other end connected to a cathode side of the diode 80 placed in the positive output line 76 via the capacitor 86.

A procedure for starting the above-described high-pressure discharge lamp 12 of the lighting system 10 will be described. When a switch (not shown) of the starting device 16 is turned on, pulse width control is performed at an FET switching section 68 in the main lighting circuit 60. An output from the FET switching section 68 is smoothed with the reactor 70 and the smoothing capacitor 72, and then output voltage v0 is outputted to the positive output line 76. The output voltage v0 on the positive output line 76 is about 300V when the high-pressure discharge lamp 12 is started. On the other hand, when the high-pressure discharge lamp 12 steadily emits light, the output voltage v0 is lowered (to 80V, for example, but actually to 50 to 120V due to fluctuation and variation in voltage), and is then kept nearly at a constant voltage level.

When the high-pressure discharge lamp 12 emits light steadily, the output from the main lighting circuit 60 passes through the high-pressure discharge lamp 12, flows along the zero voltage line 78. And voltage is generated at the sense resistor 74. The pulse width control circuit 66 detects a starting current flowing through the high-pressure discharge lamp 12 with the voltage at the sense resistor 74, and detects voltage on the positive output line 76, thereby controlling the FET switching section 68 such that starting power supplied to the high-pressure discharge lamp 12 is kept constant.

A case where the high-pressure discharge lamp 12 emits light steadily has been described above. Hereinafter, a case where the high-pressure discharge lamp 12 is to be started will be described. To start the high-pressure discharge lamp 12, power of +12V, for example, is supplied from an auxiliary power supply (not shown) to a terminal K1 of the high-frequency voltage generation circuit 82, and an ON signal is supplied from a start ON/OFF control circuit (not shown) to a terminal K2, whereby the transistor Q3 becomes conductive. Then, the transistors Q1 and Q2 are biased in the forward biased condition via the resistor R1, and become conductive, respectively. Since there is a slight difference in current amplification factors between the transistor Q1 and the transistor Q2, when the transistor Q1, for example, becomes conductive, the transistor Q1 reaches full conduction due to positive feedback effect of the feedback winding 89, whereas the transistor Q2 is biased in a reverse biased condition and becomes nonconductive.

In this case, parallel resonance is caused by an inductance of the primary winding 88 of the boosting transformer 84 and a capacitor C1, and resonant voltage caused by the parallel resonance is returned to the feedback winding 89, whereby the transistor Q1 and the transistor Q2 become alternately conductive and non-conductive, respectively, in a repetitive manner.

As a result, high-frequency voltage is generated at both ends of the primary winding 88. Oscillation frequency of the high-frequency voltage generated at both ends of the primary winding 88 is based on the inductance of the primary winding 88 and the capacitor C1.

Figure 2:
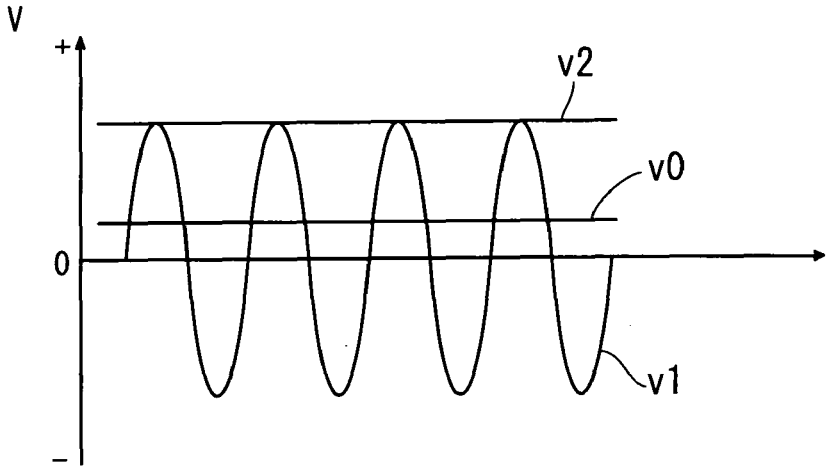
FIG. 2 is a graph illustrating output voltage from a main lighting circuit, high-frequency voltage generated at both ends of a secondary winding of a boosting transformer, and DC voltage generated at both ends of a capacitor.

When the high-frequency voltage is generated in the primary winding 88 of the boosting transformer 84, the high-frequency voltage is boosted in accordance with the turns ratio of the primary winding 88 to the secondary winding 90, and the boosted high-frequency voltage v1 occurs in the secondary winding 90. As shown in FIG. 2, the high-frequency voltage v1 is high voltage (having a peak value of 600V) of high frequency (100 kHz).

When the high-frequency voltage v1 is generated in the secondary winding 90, both ends of the capacitor 86 are charged with the high-frequency voltage v1 of positive half cycles due to rectification by the diode 80, and then DC voltage v2 (=600V) is generated at both ends of the capacitor 86.

Figure 3:
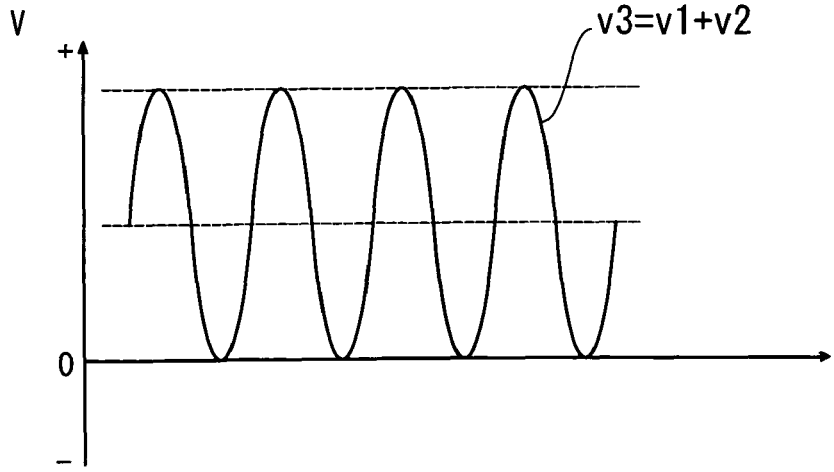
FIG. 3 is a graph illustrating composite voltage generated at both ends of a diode.

On the other hand, the secondary winding 90 of the boosting transformer 84 has one end connected to the anode side of the diode 80 placed in the forward direction in the positive output line 76 of the main lighting circuit 60, and also has the other end connected to the cathode side of the diode 80 via the capacitor 86. Accordingly, composite voltage v3 (see FIG. 3), which is the composite between the high-frequency voltage v1 generated in the secondary winding 90 and the DC voltage v2 applied to the capacitor 86, is applied to both ends of the diode 80. Since a peak voltage value of the high-frequency voltage v1 and a voltage value of the DC voltage v2 are approximately equal to each other (=600V), the composite voltage v3 forms a waveform which oscillates in a positive area only (>0V).

Figure 4:
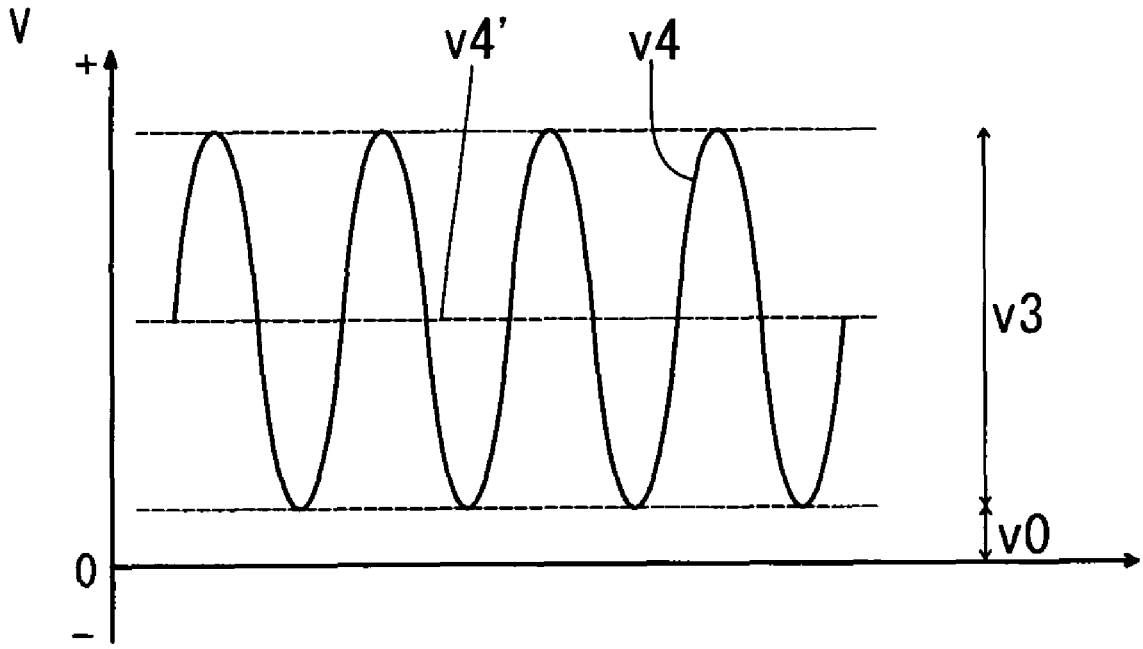
FIG. 4 is a graph showing composite voltage which is obtained as a result of superposition between the output voltage from the main discharge circuit and the composite voltage generated at both ends of the diode.

The composite voltage v3 is applied to the diode 80, and thus composite voltage v4, which is the composite between the composite voltage v3 applied to the diode 80 and the output voltage v0 from the main lighting circuit 60, is eventually applied to the high-pressure discharge lamp 12 and the auxiliary light source 14 (see FIG. 4).

The composite voltage v4 is obtained by superimposing the composite voltage v3 applied to the diode 80 with the output voltage v0, which is the DC voltage, and thus has a high-frequency component which continuously oscillates within the positive area (>0V). Accordingly, as shown in FIG. 5, it is possible to cause capacitive coupling between the internal electrode 42 and the external electrode 44 of the single-electrode auxiliary light source 14 (which may be replaced with an auxiliary light source of an "electrodeless type"), and also possible to cause the auxiliary light source 14 to emit light.

According to an experiment, it was possible to cause the auxiliary light source 14 of the single-electrode type to emit light easily by applying voltage having a frequency of 100 kHz and a peak value of 600V. In this case, 1200V (peak value=600V×2) is applied to both ends of the diode 80, and thus only one commonly used diode (withstand voltage 1500V) for high current (10 Å) is required as the diode 80. Accordingly, it is possible to achieve reduction in the size and cost of the starting circuit 62, and also possible to minimize electric power loss, which is caused by the voltage across the diode in the forward direction.

Moreover, not only the above-described high-frequency element of the composite voltage v4, but also the direct current element v4' are applied between the main discharge electrodes 34*a* and 34*b* of the high-pressure discharge lamp 12.

In this manner, in combination with the high-frequency element of the composite voltage v4 having high-peak voltage, the direct current element v4' is applied to the main discharge electrodes 34 of the high-pressure discharge lamp 12. In addition, ultraviolet rays included in the light L discharged from the auxiliary light source 14 irradiate the light-emitting material 30 and the main discharge electrodes 34*a* and 34*b*, which are enclosed in the arc tube 26 of the high-pressure discharge lamp 12, whereby dielectric breakdown between the main discharge electrodes 34 is caused easily. Accordingly, with the starting circuit 62, it is possible to easily and reliably start the high-pressure discharge lamp 12.

In this manner, after the high-pressure discharge lamp 12 is started, a glow discharge is produced, and then an arc discharge is initiated. Voltage required for an initial arc discharge is as low as about 20V. When mercury inside the arc tube 26 is evaporated, and light is emitted steadily, lamp voltage is gradually increased and is restored to a predetermined level of voltage (e.g., 80V). Thereafter, the voltage is kept at an approximately constant level, and then an OFF signal is inputted from the start ON/OFF control circuit (not shown) to the terminal K2 of the high-frequency voltage generation circuit 82, whereby the starting circuit 62 stops operating.

Figure 6:
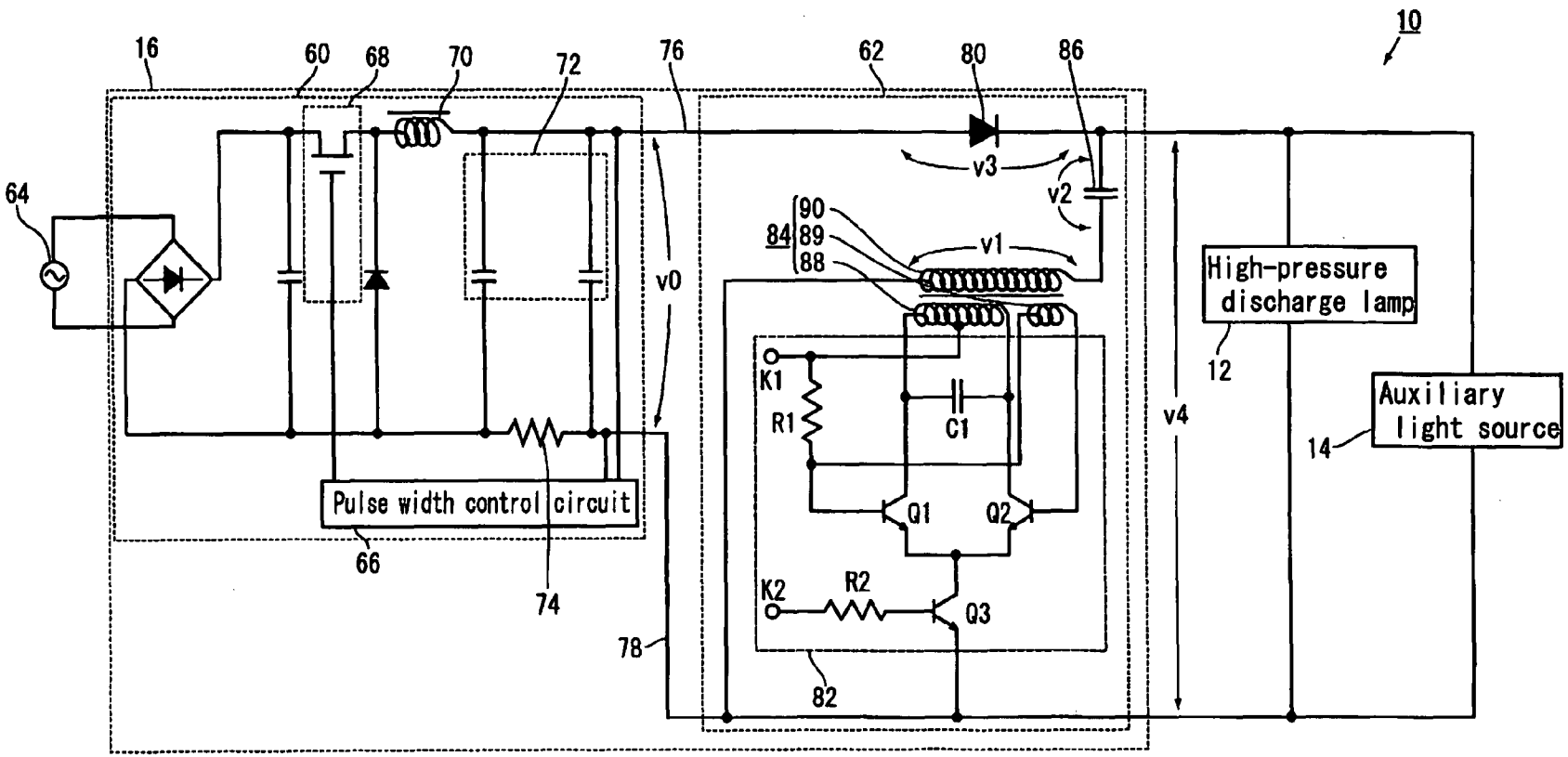
FIG. 6 is a schematic diagram showing a embodiment of a starting circuit according to the first embodiment of the present invention.

The above embodiment describes a configuration in which one end of the secondary winding 90 of the boosting transformer 84 is connected to the anode side of the diode 80 in the positive output line 76. However, such a configuration may be replaced with another configuration in which the one end of the secondary winding 90 is connected to the zero voltage line 78, namely, the other one of the output lines (see FIG. 6).

Figure 7:
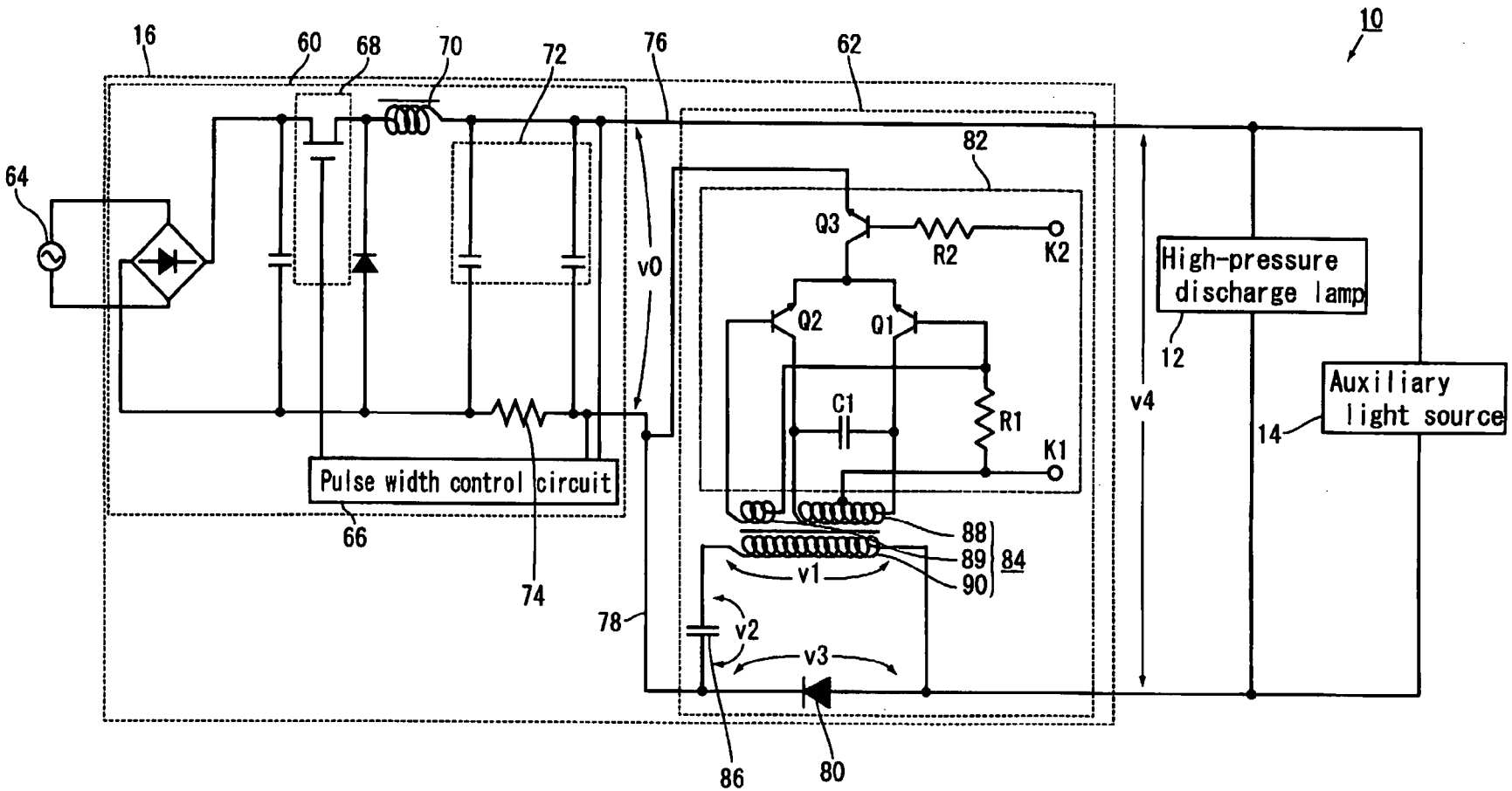
FIG. 7 is a schematic diagram showing a embodiment of a starting circuit according to the first embodiment of the present invention.

In addition, a configuration as shown in FIG. 7 is also applicable, in which the diode 80 is placed in the zero voltage line 78 in the forward biased condition, one end of the secondary winding 90 of the boosting transformer 84 is connected to the anode side of the diode 80 in the zero voltage line 78, and the other end of the secondary winding 90 is connected to the cathode side of the diode 80 in the zero voltage line 78 via the capacitor 86.

Second Embodiment

Figure 8:
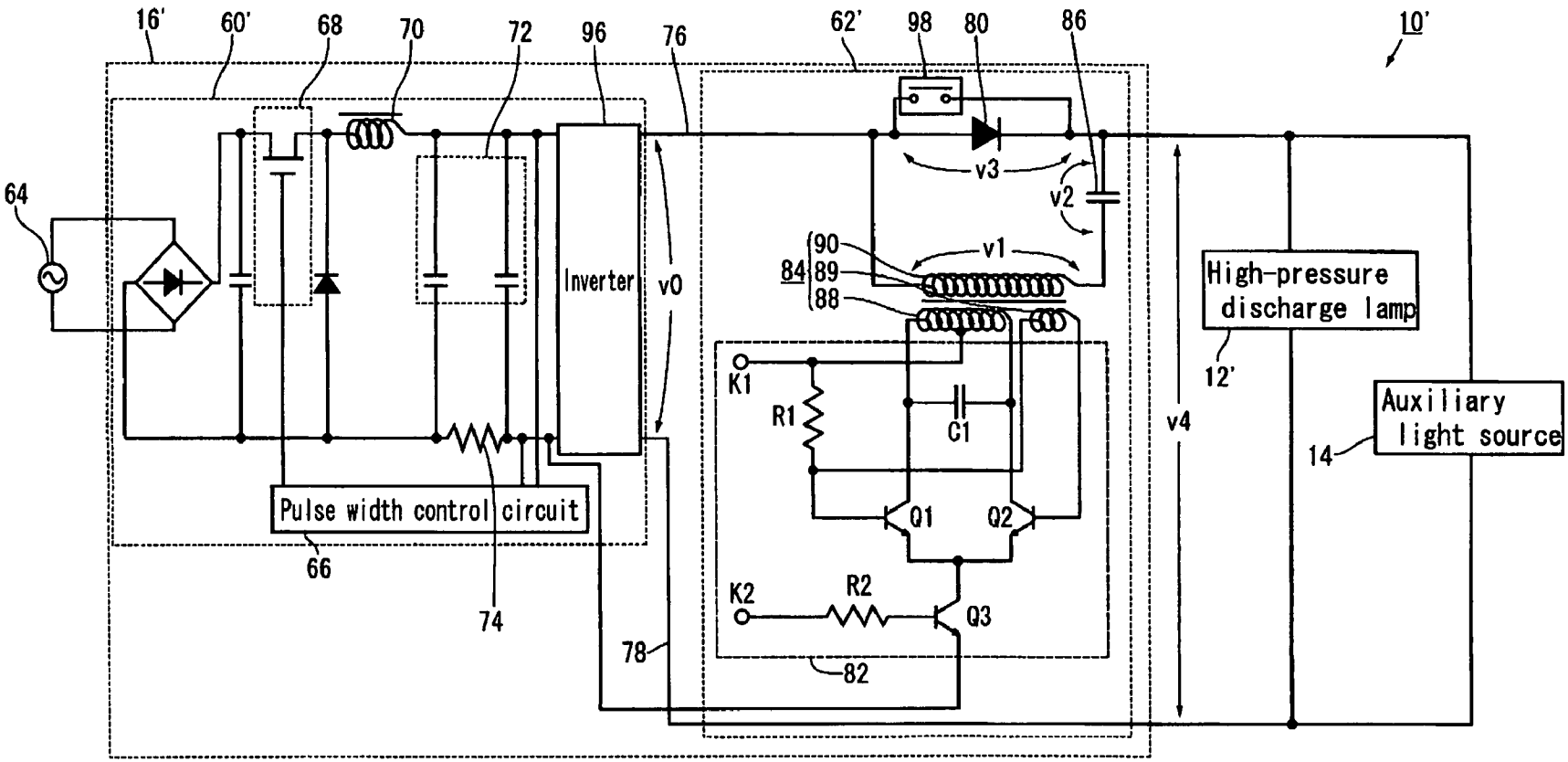
FIG. 8 is a schematic diagram showing a lighting system having an AC-powered starting device according to the present invention.
Figure 9:
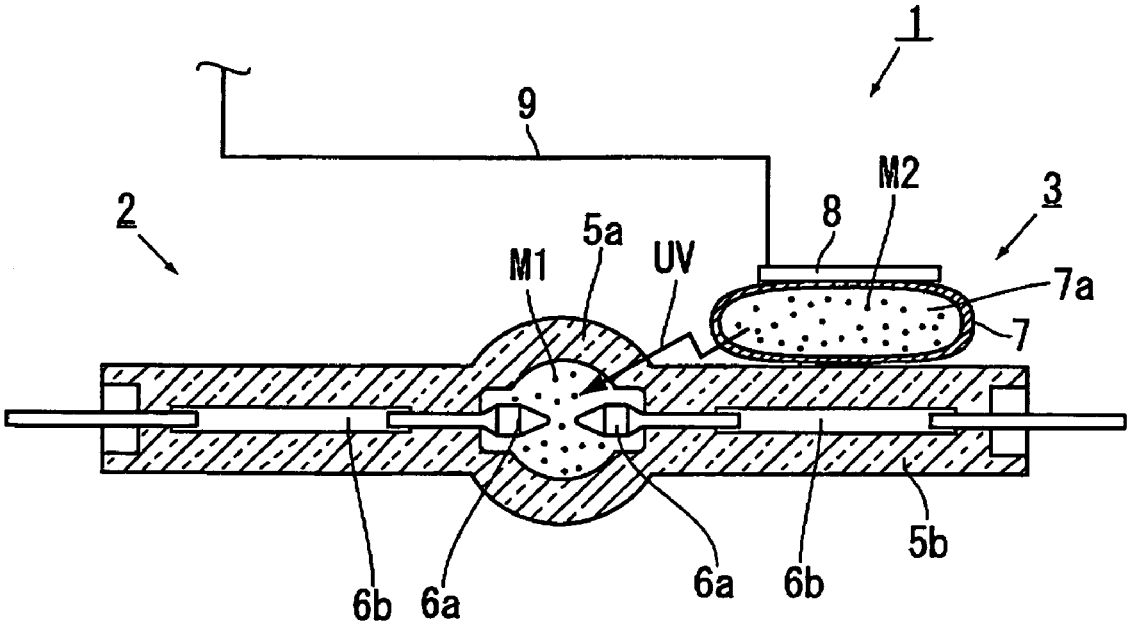
FIG. 9 Prior Art
FIG. 9 is a diagram showing a conventional art.
Figure 10:
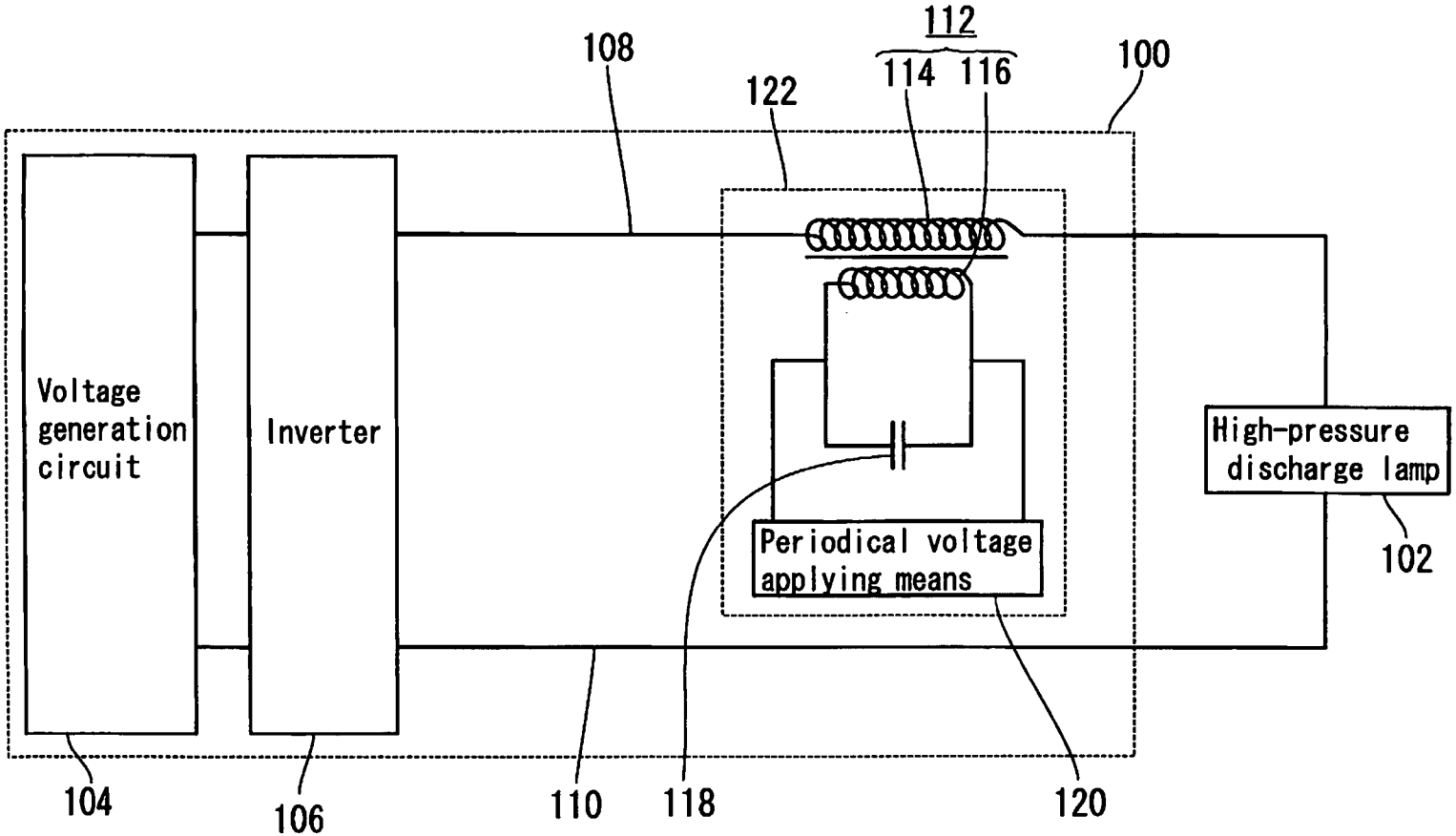
FIG. 10 Prior Art
FIG. 10 is a diagram showing a conventional art.

A lighting system 10' according to a second embodiment (see FIG. 8) includes an AC-powered high-pressure discharge lamp 12', the auxiliary light source 14, and an AC-powered starting device 16'. The DC-powered high-pressure discharge lamp 12 is used in the first embodiment, whereas the AC-powered high-pressure discharge lamp 12' is used in the second embodiment, which is a different point therebetween, and accordingly, the AC-powered starting device 16' is merely slightly different from the starting device 16. Hence, hereinafter, description in the first embodiment will be incorporated with respect to those parts which are common, and points of difference will be mainly described.

The AC-powered high-pressure discharge lamp 12' includes a pair of main discharge electrodes 34*c* and 34*d* (not shown) which are formed to be equal in size to each other.

The starting device 16' is composed of a main lighting circuit 60' and a starting circuit 62'.

The main lighting circuit 60' includes the pulse width control circuit 66, the FET switching section 68, the reactor 70 and the smoothing capacitor 72, an inverter 96 which receives a stabilized DC output that is smoothed by the reactor 70 and the smoothing capacitor 72 and which converts the DC output into an AC output, the sense resistor 74, the high-pressure discharge lamp 12', and the output lines 76 and 78 to apply voltage to the auxiliary light source 14.

The starting circuit 62' includes the diode 80, the high-frequency voltage generation circuit 82, the boosting transformer 84, the capacitor 86, and a short-circuit switch 98.

The short-circuit switch 98 has one end connected to the anode side of the diode 80, and also has the other end connected to the cathode side of the diode 80. When the high-pressure discharge lamp 12' is started, the short-circuit switch 98 receives an OFF signal from the start ON/OFF control circuit (not shown) so as to short-circuit both ends of the diode 80, and maintains such a short-circuit state while the high-pressure discharge lamp 12' emits light steadily.

Although output voltage from the main lighting circuit 60' is AC voltage, due to the presence of the diode 80, an operation of the starting device 16', when the high-pressure discharge lamp 12' is to be started, is the same as that described in the first embodiment.

When the high-pressure discharge lamp 12' is started, the OFF signal is inputted from the start ON/OFF control circuit (not shown) to the terminal K2 of the high-frequency voltage generation circuit 82, whereby the starting circuit 62' stops operating. The OFF signal is also inputted to the short-circuit switch 98, and the short-circuit switch 98 short-circuits both ends of the diode 80. Accordingly, the AC output from the main lighting circuit 60' is supplied to the high-pressure discharge lamp 12'. Thereafter, lamp voltage is gradually increased, and light is emitted steadily. Thereafter, the voltage is stabilized at a predetermined level of voltage (e.g., 80V).

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2008-171290 filed Jun. 30, 2008 including specification, drawings and claims is incorporated herein by reference in its entirety.

What is claimed is:

1. A starting circuit of a starting device for a high-pressure discharge lamp including an auxiliary light source, the starting circuit comprising:

a diode placed in a forward direction in one of a pair of output lines which connect a main lighting circuit for generating DC voltage to the high-pressure discharge lamp and the auxiliary light source;

a capacitor having one end connected to a cathode side of the diode;

a boosting transformer including a primary winding, and a secondary winding having one end connected to an anode side of the diode or to the other one of the output lines and also having the other end connected to the other end of the capacitor; and a high-frequency voltage generation circuit for continuously generating high-frequency voltage in combination with the primary winding.

2. A starting device for a high-pressure discharge lamp including an auxiliary light source, the starting device comprising:

a main lighting circuit for generating DC voltage; and the starting circuit according to claim 1.

3. A lighting system comprising:

a high-pressure discharge lamp;

an auxiliary light source; and the starting device according to claim 2.

4. A starting circuit of a starting device for a high-pressure discharge lamp including an auxiliary light source, the starting circuit comprising:

a diode placed in a forward direction in one of a pair of output lines which connect a main lighting circuit for generating AC voltage to the high-pressure discharge lamp and the auxiliary light source;

a capacitor having one end connected to a cathode side of the diode;

a boosting transformer including a primary winding, and a secondary winding having one end connected to an anode side of the diode or to the other one of the output lines and also having the other end connected to the other end of the capacitor;

a high-frequency voltage generation circuit for continuously generating high-frequency voltage in combination with the primary winding; and a short-circuit switch for maintaining a short-circuit condition between both ends of the diode after the high-pressure discharge lamp is started.

5. A starting device for a high-pressure discharge lamp including an auxiliary light source, the starting device comprising;

a main lighting circuit for generating AC voltage; and the starting circuit according to claim 4.

6. A lighting system comprising:

a high-pressure discharge lamp;

an auxiliary light source; and the starting device according to claim 5.

* * * * *